United States Patent [19]

McLoughlin et al.

[11] 4,246,969

[45] Jan. 27, 1981

[54] CHEMICAL INJECTION SYSTEM FOR FIRE FIGHTING

[75] Inventors: John McLoughlin, 92 Mobrey La., Smithtown, N.Y. 11787; Neocles Athanasiades, Setauket, N.Y.; Yehuda Rotblum, Lake Grove, N.Y.

[73] Assignee: John McLoughlin, Smithtown, N.Y.

[21] Appl. No.: 10,180

[22] Filed: Feb. 7, 1979

[51] Int. Cl.[3] ..... A62C 35/16

[52] U.S. Cl. ..... 169/13; 137/101.21; 169/15; 222/55; 222/63; 222/133; 239/61

[58] Field of Search ..... 169/13, 14, 15, 27; 239/61, 310; 222/57, 133, 145, 55, 63, 71, 134, 135; 137/101.21

[56] References Cited

U.S. PATENT DOCUMENTS

| | | | |
|---|---|---|---|
| 2,872,072 | 2/1959 | Reed | 222/145 X |
| 3,038,486 | 6/1962 | Thurman | 137/101.21 X |
| 3,115,158 | 12/1963 | Sheppard | 169/14 X |
| 3,123,252 | 3/1964 | Kuntz | 222/57 X |
| 3,520,448 | 7/1970 | Russell | 222/57 |
| 3,642,171 | 2/1972 | Ernst | 222/57 X |
| 3,900,043 | 8/1975 | Bowen et al. | 137/101.21 |

*Primary Examiner*—Stanley H. Tollberg
*Assistant Examiner*—Fred A. Silverberg
*Attorney, Agent, or Firm*—James P. Malone

[57] ABSTRACT

A system for injecting chemicals into a fire fighting system of the type using a plurality of water hoses and having a source of water and a source of chemicals. A servo motor system is connected to automatically meter a certain ratio of chemicals into the water supply. The servo motor system is responsive to the total flow to control the chemical pump to pump a certain ratio of chemicals into the water supply even if the total flow varies.

1 Claim, 3 Drawing Figures

CHEMICAL INJECTION SYSTEM FOR FIRE FIGHTING

This invention relates to chemical injection means for fire fighting and more particularly to an automatic electrically controlled system for providing a desired ratio of chemicals to total flow.

BACKGROUND OF THE INVENTION

Foam or other type chemicals are frequently added to the water used in fighting fires. A desired ratio of chemicals to total flow is desirable but this is difficult to achieve and maintain since the total flow is liable to change quite often, for instance, due to change in the supply pressure or due to the adding or subtracting of hoses from the water supply.

Conventional chemical injection apparatus generally uses manually operated mechanical mixing apparatus.

The present invention provides means to automatically meter a certain ratio of chemicals into the water supply and this ratio is maintained electrically.

In one embodiment, a servo motor responsive to the total flow controls the pump for the chemical In another embodiment a valve is automatically controlled to control the chemical.

SUMMARY OF THE INVENTION

The present injection system is designed to inject any type of fire fighting chemical such as rapid water, wet water or penetrating agents and increases the capability of a fire fighting system. Using a Flow Monitoring System, it is possible to measure the total flow out of a vehicle. When the total flow is known, it is a matter of operating an electric driven positive displacement pump at the correct speed to give an accurate mixing ratio. The present inexpensive system is designed to give years of service to any fire truck that it is installed on.

Accordingly, a principal object of the invention is to provide new and improved means to inject chemicals into water in fire fighting systems.

Another object of the invention is to provide new and improved means to inject chemicals into water in fire fighting systems including means to maintain a desired ratio between chemical and total flow.

Another object of the invention is to provide new and improved means to inject chemicals into a fire fighting system of the type using a plurality of water hoses comprising, a source of water supply, a source of chemicals, and means to automatically meter a certain ratio of chemicals into the water supply.

These and other objects of the invention will be apparent from the following specification and drawings of which:

DESCRIPTION OF PREFERRED EMBODIMENT

Figure 1:
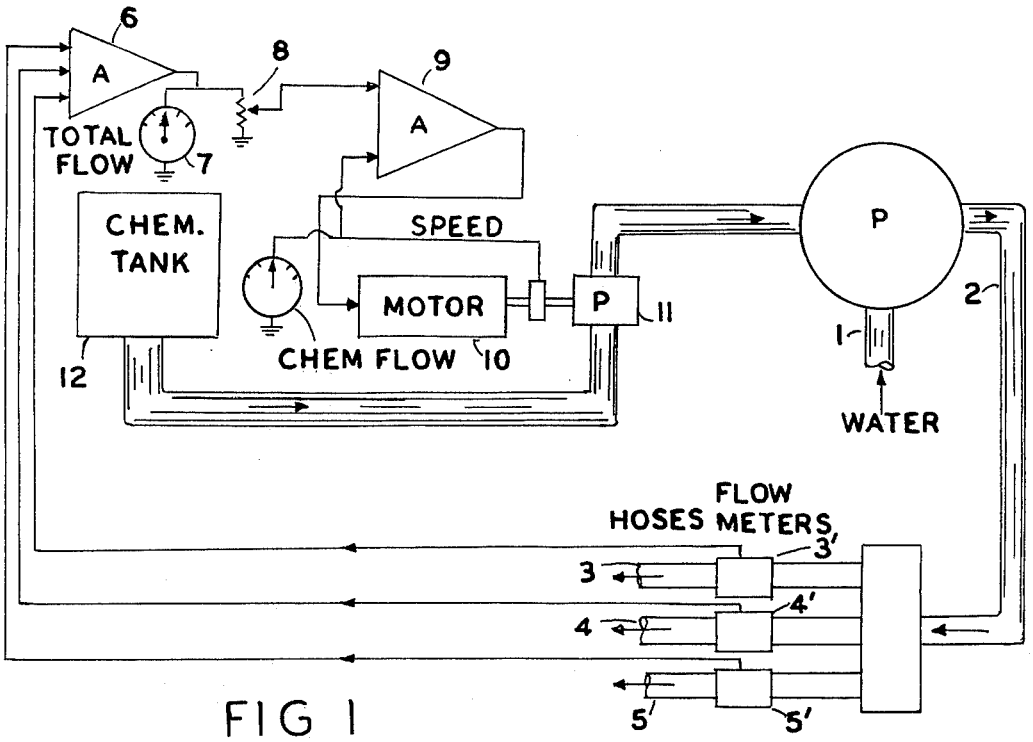
FIG. 1 is a schematic diagram of the embodiment of the invention.

Referring to FIG. 1, water is supplied from a hose through the pipe 1, to the pump P and the output 2. The pump P is connected to the hoses 3, 4, 5 and flow meters

3', 4', 5', are connected to each hose. The outputs of the flow meters are connected to the input of amplifier 6 which provides an indication of total flow which may be read on the meter 7. A signal proportional to total flow is connected to potentiometer 8, the output of which is connected to the amplifier 9. The function of potentiometer 8 is to set in a desired ratio between chemicals and total flow. The output of amplifier 9 is connected to an electric motor 10 which operates a pump 11, which pumps foam or chemical flow from the tank 12 to the water pump P.

By setting in the desired ratio on the potentiometer 8 the desired ratio will be maintained by the amplifier 9 controlling the speed of the electric motor 10, which in turn controls the chemical pump 11.

Figure 2:
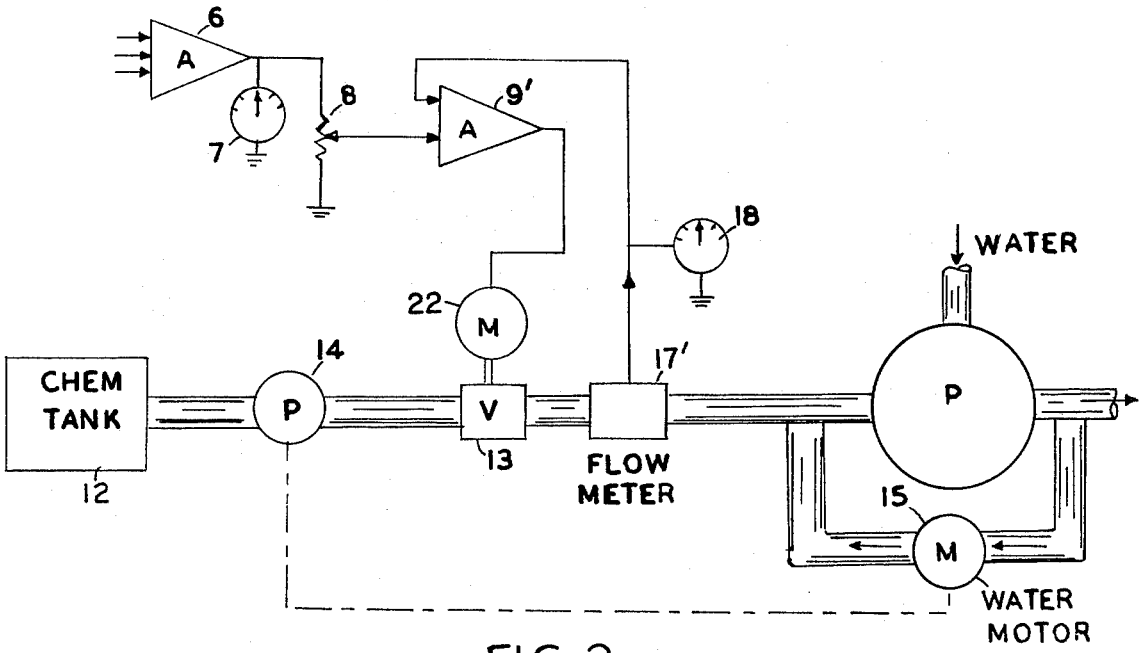
FIGS. 2 and 3 are schematic diagrams of modifications of the invention.

FIG. 2 illustrates a modification of the invention which is similar to the embodiment of FIG. 1 except that instead of controlling an electric motor and pump the servo amplifier 9' controls a motor 22 which controls valve 13 and it is valve 13 which controls the ratio of chemical to total flow. In this embodiment the chemical pump 14 is driven by a water driven motor 15 which is driven by water flow in the system.

In FIG. 2 the ratio is set into the potentiometer 8 and the amplifier 9' is responsive to the ratio from potentiometer 8 and the chemical flow from the flow meter 17'. The gauge 18 reads the chemical flow.

Figure 3:
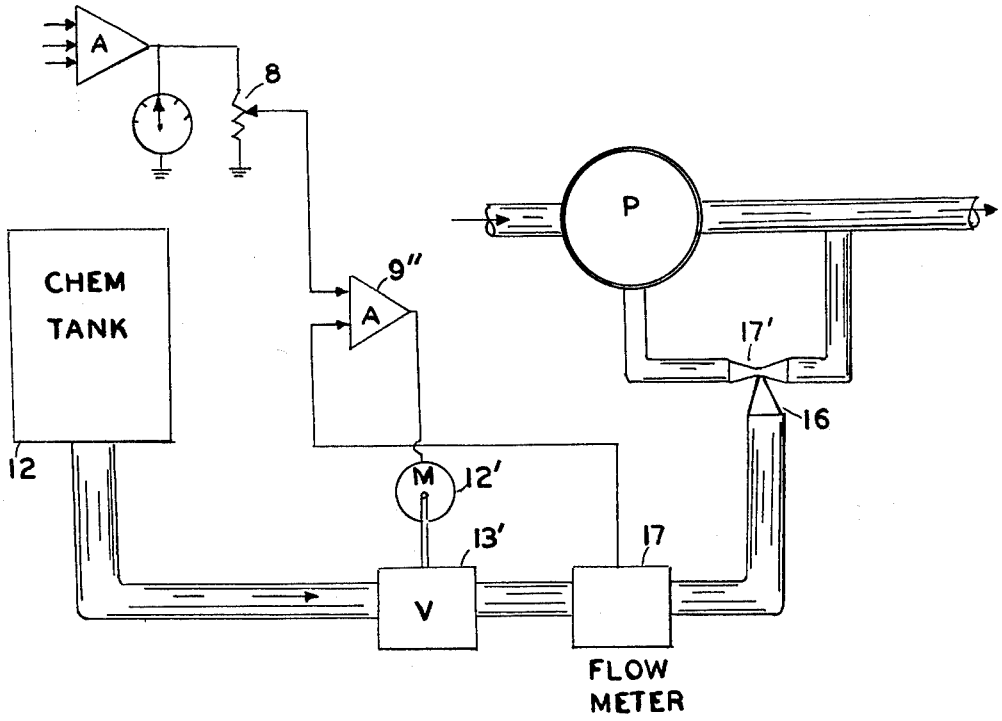

FIG. 3 illustrates another embodiment of the invention which is similar to the embodiment of FIGS. 1 and 2. In this embodiment, the amplifier 9'' drives a servo motor 12' which controls the chemical valve 13'. In this embodiment the chemical is sucked out of the tank because of the connection of the chemical pipe 16 to a Venturi connection 17' in the water supply. Therefore no chemical pump is necessary. The servo motor part of the system is similar to FIG. 2. The ratio is set in on the potentiometer 8 and amplifier 9'' is responsive to the ratio of total flow and the chemical flow from the flow meter 17.

It is claimed:

1. The means to inject chemicals into a fire fighting system using a plurality of water hoses which may be added to or subtracted from the system comprising:

a source of water supply, a source of chemicals, and means to automatically meter a certain ratio of chemicals into the water supply, comprising:

means to measure the total flow of the plurality of hoses, a chemical pump connected to the chemical source, and connected to pump chemicals into the water supply, and water driven motor responsive to the water flow to control the chemical pump to pump a certain ratio of chemicals into the water supply, the metering means comprising:

a first amplifier responsive to the total flow, and a potentiometer to set a desired ratio factor into a second amplifier comprising:

a valve connected to the output of the chemical pump, the first amplifier being connected to the potentiometer which is connected to the second amplifier to control a motor which controls the valve.

* * * * *